US007331374B2

(12) United States Patent
Lewis, Jr. et al.

(10) Patent No.: US 7,331,374 B2
(45) Date of Patent: Feb. 19, 2008

(54) METHOD AND APPARATUS FOR ASSISTING REMOVAL OF SAND MOLDINGS FROM CASTINGS

(75) Inventors: James L. Lewis, Jr., Kennesaw, GA (US); Ian French, Kennesaw, GA (US); Volker R. Knobloch, Woodstock, GA (US); Scott P. Crafton, Marietta, GA (US); Paul M. Crafton, Kennesaw, GA (US); James R. Garrett, Acworth, GA (US); John W. Dalton, Acworth, GA (US)

(73) Assignee: Consolidated Engineering Company, Inc., Kennesaw, GA (US)

( * ) Notice: Subject to any disclaimer, the term of this patent is extended or adjusted under 35 U.S.C. 154(b) by 566 days.

(21) Appl. No.: 10/616,750

(22) Filed: Jul. 10, 2003

(65) Prior Publication Data

US 2004/0055728 A1 Mar. 25, 2004

Related U.S. Application Data

(63) Continuation-in-part of application No. 09/852,256, filed on May 9, 2001, now Pat. No. 6,622,775.

(60) Provisional application No. 60/395,057, filed on Jul. 11, 2002.

(51) Int. Cl.
*B22D 39/00* (2006.01)

(52) U.S. Cl. ..... 164/131; 164/132; 164/48; 164/501

(58) Field of Classification Search ..... 164/131, 164/132, 344, 404, 48, 501
See application file for complete search history.

(56) References Cited

U.S. PATENT DOCUMENTS

| | | | |
|---|---|---|---|
| 22,865 | A | 2/1859 | Gardiner |
| 185,376 | A | 12/1876 | Whitehouse |
| 381,655 | A | 4/1888 | Stover |
| 927,495 | A | 7/1909 | Custer |
| 1,241,867 | A | 10/1917 | McMillen |

(Continued)

FOREIGN PATENT DOCUMENTS

CA 1197981 12/1985 ..... 38/18

(Continued)

OTHER PUBLICATIONS

Economical Used Energy Type Continuing Heat Treating Furnace For Aluminum Castings Dogyo—Kanetsu vol. 21 No. 2 pp. 29-36—Mar. 1984.

(Continued)

*Primary Examiner*—Jonathan Johnson
*Assistant Examiner*—I.-H. Lin
(74) *Attorney, Agent, or Firm*—McGuireWoods LLP

(57) ABSTRACT

Disclosed is a method for dislodging a mold from a casting formed within the mold. The mold may be removed from the casting by scoring the mold and applying a force sufficient to cause the mold to fracture and break into pieces. Additionally, the mold may be fractured by either explosive charges placed in the mold pack or by high energy pulsations directed at the mold. Once the mold is fractured and broken into various pieces it may then be dislodged from the casting.

34 Claims, 7 Drawing Sheets

U.S. PATENT DOCUMENTS 2,385,596 A 10/1945 Barnett ..... 34/13
2,385,962 A 10/1945 Barnett ..... 34/13
2,813,318 A 11/1957 Horth ..... 22/89
2,968,848 A 1/1961 Carter
2,988,351 A 6/1961 Barnett et al. ..... 263/40
3,124,452 A 3/1964 Kraft
3,351,687 A 11/1967 Thome et al. ..... 432/133
3,506,057 A * 4/1970 Pennock et al. ..... 164/19
3,534,946 A 10/1970 Westerkamp et al. ..... 263/28
3,540,519 A 11/1970 Yates
3,620,291 A 11/1971 Detachapelle
3,627,020 A * 12/1971 Taccone ..... 164/131
3,737,280 A 6/1973 Cromp ..... 432/14
3,743,692 A * 7/1973 Vinton et al. ..... 264/334
3,760,800 A 9/1973 Staffin et al. ..... 128/24.1
3,863,702 A 2/1975 Hallerberg et al.
3,871,438 A 3/1975 Vissers et al. ..... 164/5
3,958,619 A 5/1976 Petersen et al.
3,993,420 A 11/1976 Haas et al. ..... 425/127
4,068,389 A 1/1978 Staffin et al. ..... 34/57 A
4,089,702 A 5/1978 Enoksson et al.
4,140,467 A 2/1979 Ellison et al. ..... 432/72
4,161,389 A 7/1979 Staffin et al. ..... 432/58
4,177,952 A 12/1979 Rikker ..... 241/40
4,211,274 A 7/1980 Slowinski et al. ..... 164/401
4,222,429 A 9/1980 Kemp
4,242,077 A 12/1980 Hyre ..... 431/19
4,294,436 A 10/1981 Takahashi ..... 266/257
4,316,744 A * 2/1982 Bergna ..... 106/38.35
4,325,424 A 4/1982 Scheffer ..... 164/5
4,340,433 A 7/1982 Harding ..... 148/16
4,347,890 A 9/1982 Aillin-Pyzik et al.
4,374,538 A 2/1983 Rice et al.
4,392,814 A 7/1983 Harding ..... 431/170
4,399,858 A 8/1983 Kurabe et al.
4,411,709 A 10/1983 Nakanishi ..... 148/3
4,415,444 A 11/1983 Guptail ..... 209/3
4,427,375 A 1/1984 Di Rosa ..... 432/58
4,457,352 A 7/1984 Scheffer ..... 164/5
4,457,788 A 7/1984 Staffin et al. ..... 148/20.3
4,478,572 A 10/1984 Selli ..... 432/13
4,490,107 A 12/1984 Kimura et al. ..... 432/11
4,499,940 A 2/1985 Hall ..... 164/36
4,512,821 A 4/1985 Staffin et al. ..... 148/16.5
4,519,718 A 5/1985 Staffin et al. ..... 374/45
4,524,957 A 6/1985 Staffin et al. ..... 266/252
4,544,013 A 10/1985 Kearney et al. ..... 164/5
4,547,228 A 10/1985 Girrell et al. ..... 148/16
4,548,256 A 10/1985 Glinn et al.
4,577,671 A 3/1986 Stephan ..... 164/401
4,579,319 A 4/1986 Sasaki ..... 266/252
4,580,616 A 4/1986 Watts
4,582,118 A 4/1986 Jacoby et al.
4,582,301 A 4/1986 Wunning ..... 266/87
4,604,055 A 8/1986 Mackenzie ..... 432/58
4,607,091 A 8/1986 Schreiber
4,610,295 A 9/1986 Jacoby et al.
4,613,713 A 9/1986 Staffin et al. ..... 585/241
4,620,586 A 11/1986 Musschoot ..... 164/253
4,623,400 A 11/1986 Japka et al. ..... 148/6.35
4,627,814 A 12/1986 Hattori et al. ..... 432/128
4,629,708 A 12/1986 Alexander et al.
4,648,836 A 3/1987 Thom ..... 432/107
4,671,496 A 6/1987 Girrell et al. ..... 266/78
4,681,267 A 7/1987 Leidel et al. ..... 241/23
4,700,766 A 10/1987 Godderidge ..... 164/5
4,709,740 A 12/1987 Jacoby et al.
4,724,887 A 2/1988 Jacoby et al.
4,779,163 A 10/1988 Bickford et al. ..... 361/212
4,802,525 A * 2/1989 Heine et al. ..... 164/48
4,830,605 A 5/1989 Hodate et al. ..... 431/170
4,955,425 A 9/1990 McKenna ..... 164/269
4,987,950 A 1/1991 Yu
5,018,707 A 5/1991 Hemsath et al. ..... 266/254
5,052,923 A 10/1991 Peter et al. ..... 432/207
5,143,665 A 9/1992 Clubbs et al.
5,148,853 A 9/1992 Yu et al.
5,158,130 A 10/1992 Sahari
5,169,913 A 12/1992 Staffin et al. ..... 526/65
5,239,917 A 8/1993 Lutkie et al. ..... 99/443 C
5,251,683 A 10/1993 Backer ..... 164/98
5,253,698 A 10/1993 Keough et al. ..... 164/269
5,263,652 A 11/1993 Iwanami et al. ..... 241/57
5,294,094 A 3/1994 Crafton et al. ..... 266/44
5,294,648 A 3/1994 Smith et al.
5,318,092 A * 6/1994 Andrews ..... 164/14
5,327,955 A * 7/1994 Easwaran ..... 164/516
5,333,673 A 8/1994 Hughes
5,350,160 A 9/1994 Crafton et al. ..... 266/252
5,354,038 A 10/1994 Crafton ..... 266/44
5,372,195 A * 12/1994 Swanson et al. ..... 166/308.1
5,378,434 A 1/1995 Staffin et al. ..... 422/141
5,423,370 A 6/1995 Bonnemersou et al. ..... 164/132
5,439,045 A 8/1995 Crafton ..... 164/5
5,443,383 A 8/1995 Kuehn ..... 432/128
5,477,906 A * 12/1995 Legge et al. ..... 164/122.1
5,531,423 A 7/1996 Crafton et al. ..... 266/44
5,551,998 A 9/1996 Crafton et al. ..... 148/538
5,565,046 A 10/1996 Crafton et al. ..... 148/538
5,573,055 A 11/1996 Melling et al.
5,632,326 A 5/1997 Gough
5,641,015 A 6/1997 Challand
5,681,407 A 10/1997 Yu et al.
5,725,044 A 3/1998 Hirokawa
5,738,162 A 4/1998 Crafton ..... 164/5
5,778,963 A 7/1998 Parille et al.
5,780,763 A * 7/1998 Schimmel et al. ..... 102/302
5,810,918 A 9/1998 Landis
5,820,705 A 10/1998 Yu et al.
5,829,509 A 11/1998 Crafton ..... 164/5
5,850,866 A 12/1998 Crafton ..... 164/5
5,901,775 A * 5/1999 Musschoot et al. ..... 164/404
5,913,354 A 6/1999 Conroy et al.
5,915,452 A 6/1999 Conroy et al.
5,957,188 A 9/1999 Crafton
5,983,984 A 11/1999 Auderheide et al.
6,042,369 A 3/2000 Bergman et al. ..... 432/15
6,112,803 A 9/2000 Kruger ..... 164/103
6,139,619 A 10/2000 Zaretskiy
6,205,959 B1 * 3/2001 Smetan et al. ..... 123/41.74
6,286,585 B1 9/2001 Twardowska et al.
6,335,387 B1 1/2002 Twardowska et al.
6,336,809 B1 1/2002 Crafton
6,352,123 B1 * 3/2002 Schlegel et al. ..... 172/439
6,372,032 B1 4/2002 Miki
6,390,178 B1 5/2002 Makino
6,416,572 B1 7/2002 Eldemallawy et al.
6,447,593 B1 9/2002 Sargent et al.
6,469,299 B2 10/2002 Chutjian et al.
6,547,556 B2 4/2003 Crafton et al.
6,551,396 B1 4/2003 Pineda et al.
6,622,775 B2 * 9/2003 Crafton et al. ..... 164/131
6,672,367 B2 1/2004 Crafton et al.
2002/0020511 A1 2/2002 Crafton et al.
2002/0104596 A1 8/2002 Crafton et al.
2004/0055728 A1 3/2004 Lewis, Jr. et al.
2005/0022957 A1 2/2005 Crafton et al.
2005/0072549 A1 4/2005 Crafton et al.
2005/0145362 A1 7/2005 Crafton et al.

FOREIGN PATENT DOCUMENTS

CH 622 726 A5 4/1981
DE 1 030 974 9/1955

| | | | | |
|---|---|---|---|---|
| DE | A-1 962 182 | | 8/1970 | |
| DE | 2307773 | | 2/1973 | |
| DE | 2315958 | | 4/1974 | |
| DE | 2337894 | | 11/1974 | |
| DE | 2914221 | | 4/1979 | |
| DE | 3206048 | | 2/1982 | |
| DE | 3215809 | | 4/1982 | |
| DE | 32 15 809 | C1 | 11/1983 | |
| DE | 36 16 166 | A1 | 11/1987 | |
| DE | 4012158 | | 11/1990 | ..... 164/5 |
| DE | 195 25 307 | A1 | 1/1997 | |
| DE | 195 30 975 | | 2/1997 | |
| EP | 0 077 511 | | 10/1982 | |
| EP | 0 141 666 | | 5/1985 | |
| EP | 0 141 666 | A2 | 5/1985 | |
| EP | 0 119 365 | B1 | 9/1987 | |
| EP | 0546210 | A1 | 6/1993 | |
| EP | 0 744 233 | A2 | 11/1996 | |
| EP | 0 744 233 | A3 | 11/1996 | |
| EP | 0 796 681 | A2 | 9/1997 | |
| FR | 7043571 | | 12/1970 | |
| FR | 2448573 | | 2/1979 | |
| FR | 2 614 814 | A3 | 11/1988 | |
| GB | 1392405 | | 4/1975 | |
| GB | 1 549 220 | | 7/1979 | |
| GB | 1564151 | | 4/1980 | |
| GB | 1569152 | | 6/1980 | |
| GB | 2 070 627 | A | 9/1981 | |
| GB | 2137114 | | 10/1984 | |
| GB | 2187398 | | 9/1987 | |
| GB | 2230720 | | 10/1990 | |
| GB | 2 248 569 | A | 4/1992 | |
| GB | 2248569 | | 4/1992 | |
| JP | 55077972 | * | 6/1980 | ..... 164/132 |
| JP | 5653867 | | 5/1981 | |
| JP | 5939464 | | 8/1982 | |
| JP | 5825417 | | 2/1983 | |
| JP | 5825860 | | 2/1983 | |
| JP | 59219410 | | 12/1984 | |
| JP | 6092040 | | 5/1985 | ..... 164/132 |
| JP | 2074022 | | 9/1985 | |
| JP | 61007058 | | 1/1986 | |
| JP | 62110248 | | 5/1987 | |
| JP | 6316853 | | 1/1988 | ..... 164/132 |
| JP | 63108941 | | 5/1988 | |
| JP | 1-91957 | | 4/1989 | ..... 164/132 |
| JP | 1-122658 | | 5/1989 | |
| JP | 2104164 | | 4/1990 | |
| JP | 3-465 | | 1/1991 | |
| JP | 5-169185 | | 7/1993 | |
| JP | 09182952 | * | 7/1997 | |
| SU | 1129012 | | 7/1982 | |
| SU | 0234810 | | 3/1985 | ..... 164/132 |
| WO | WO 93 19870 | | 10/1993 | |
| WO | WO 97/30805 | | 8/1997 | |
| WO | WO 98/14291 | | 4/1998 | |
| WO | WO 01/08836 | A1 | 2/2001 | |

OTHER PUBLICATIONS

Brochures describing Beardsley & Pipe PNEU-RECLAIM Sand Reclamation Units Prior to Aug. 13, 1992.

Brochure describing Fataluminum Sand Reclamation Units—Prior to Aug. 13, 1992.

Paul M. Crafton—Heat Treating Aging System Also Permits Core Sand Removal—Reprinted from Sep. 1989 Modern Castings magazine.

Preliminary Remarks dated Jul. 30, 1991 and filed in U.S. Appl. No. 07/705,626.

Declaration of Paul M. Crafton & Scott P. Crafton dated Jul. 26, 1991 and filed in U.S. Appl. No. 07/705,626.

On Sale Description regarding System of Consolidated Engineering System (before Aug. 13, 1992).

Sales brochure describing Thermfire Brand Sand Reclamation, Gudgeon Bros., Ltd. believed to be known to others prior to Sep. 1989.

Sales brochure describing Simplicity/Richards Gas-Fired Thermal Reclamation System Simplicity Engineering, Inc.—believed to be known to others prior to Sep. 1989.

Sales brochure describing AirTrac Brand Fluidizing Conveyor, Air Trac Systems Corp., believed to be known to others prior to Sep. 1989.

Sales brochure describing Fluid Bed Calcifer Thermal Sand Reclamation Systems, Dependable Foundry Equipment Co.—Believed to be known to others prior to Sep. 1989.

Patent Abstracts of Japan, JP-60247458 (Mazda Motor Corp.) Dec. 7, 1985.

Niedling, Jake J. et al., "Evaluating RSI Sows For Safe Charging Into Molten Metal," Light Metals 2003, TMS (The Minerals, Metals & Materials Society), 2003, pp. 695-700.

Ekenes, J. Martin et al., "Cause and Prevention of Explosions Involving Hot-Top Casting of Aluminum Extrusion Ingot," Light Metals 2003, TMS (The Minerals, Metals & Materials Society), 2003, pp. 687-693.

Patent Abstracts of Japan, vol. 010, No. 118, May 2, 1986 & JP 60 247458 (Mazda KK) Dec. 7, 1985.

Patent Abstracts of Japan; Publication No. 61007058; Publication Date Jan. 13, 1986.

Patent Abstracts of Japan, vol. 11, No. 094 Mar. 25, 1987 & JP 61 245938, Asahi Organic Chem. Ind. Co. Ltd., Nov. 1, 1986.

Veltrup E.M., "Kurze Entkernungszeiten Beim Entkernen Mit Hochdruckwasserstrah," Giesserel, Guesserei Verlag, Dusseldorf, Germany, vol. 74, No. 4, Feb. 18, 1987, pp. 102-104.

* cited by examiner

METHOD AND APPARATUS FOR ASSISTING REMOVAL OF SAND MOLDINGS FROM CASTINGS

CROSS-REFERENCE TO RELATED APPLICATIONS

This application claims priority to U.S. Provisional Application Ser. No. 60/395,057, filed Jul. 11, 2002, and is a continuation-in-part of U.S. Pat. application Ser. No. 09/852,256, filed May 9, 2001.

FIELD OF THE INVENTION

The present invention relates generally to the manufacturing of metal castings and more particularly to manufacturing castings within sand molds and enhancing the removal of the sand molds and cores from the castings.

BACKGROUND

A traditional casting process for forming metal castings generally employs a mold or die, such as a permanent, metal die or a sand mold, having the exterior features of a desired casting, such as a cylinder head, formed on its interior surfaces. A sand core comprised of sand and a suitable binder material and defining the interior features of the casting is typically placed within the die to further define the features of the casting. Sand cores generally are used to produce contours and interior features within the metal castings, and the removal and reclaiming of the sand materials of the cores from the castings after the casting process is completed is a necessity.

Depending upon the application, the binder for the sand core and/or sand mold may comprise a phenolic resin binder, a phenolic urethane "cold box" binder, or other suitable organic binder material. The die or mold is then filled with a molten metallic alloy, which is allowed to cool to a certain, desired degree to cause the alloy to solidify. After the alloy has solidified into a casting, the casting is then moved to a treatment furnace or furnaces for further processing, including heat-treating, reclamation of the sand from the sand cores, and aging. Heat treating and aging are processes that condition metallic alloys so that they will be provided with different physical characteristics suited for different applications.

The sand molds and/or cores generally are removed from the casting prior to completion of heat treatment. The sand molds and/or cores are typically separated from their castings by one or a combination of means. For example, sand may be chiseled away from the casting or the casting may be physically shaken or vibrated to break-up the sand molds and internal sand cores within the castings and remove the sand. In addition or alternately, as the sand molds and castings are passed through a heat treatment and/or thermal sand removal furnace, the organic or thermally degradable binder for the sand molds and cores, generally is broken down or combusted by exposure to the high temperatures for heat treating the castings to a desired metal properties so that the sand from the molds and cores can be removed from the castings and reclaimed, leaving the finished, heat-treated castings. Furnace systems and methods of heat treating castings are found in U.S. Pat. Nos. 5,957,188, 5,829,509, and 5,439,045, each of which is expressly incorporated herein in its entirety by reference. Heat treating and aging of the casting are performed during and/or after the sand removal process.

Technology such as that disclosed in the above mentioned patents is driven, for example, by competition, increasing costs of raw materials, energy, labor, waste disposal, and environmental regulations. These factors continue to mandate improvements in the field of heat-treating and reclamation of sand from such metal castings.

SUMMARY

The present invention comprises a method and system for enhancing the removal of sand molds and cores from castings. The method and system generally includes directing an energized stream at the casting in order to degrade the casting and dislodging or otherwise removing at least a portion of the degraded mold from the casting. The energized stream may include any one or more of pressurized fluids, particles, lasers, electromagnetic energy, or explosives. According to one embodiment of the present invention, a sand mold may be removed from a casting by scoring the mold at predetermined locations or points about the mold and applying a force sufficient to cause the mold to fracture and break into pieces. For example, molds may be fractured by thermal expansion of the castings being heated therein, and/or by the application of radiant energy or inductive energy to the molds, and/or by other applications of force and/or energy to the mold or casting. Additionally, pressurized fluids, particle streams, pulses and/or shockwaves also may be directed at the exterior walls of the mold or introduced into one or more openings or recesses in the mold to further aid in breaking down the mold. The molds and/or cores are fractured, broken into various pieces or otherwise degraded and dislodged from the casting. Indeed, the fracturing or breaking of the molds and cores alone may serve to dislodge or otherwise remove the fractured portions from the castings. The castings may be heat treated as the pieces of the sand molds are heated, for example but not necessarily, in the same heat treatment furnace or by the same heat used during heat treatment, to a temperature sufficient to cause the binder materials thereof to combust leading to the breakdown and reclamation of sand from the molds and cores.

The methods and systems of the present invention generally are directed to use with precision sand molds, green sand molds, semi-permanent molds and the like, which molds generally are designed to be broken down and removed from their castings, such as during heat treatment. Other types of molds having sections that are mated together such as along joint lines also can be used in the present invention. For example, the present invention can be utilized with core locking type molds in which the molds are formed in sections that are held together by a central locking core piece which will be fractured and/or broken by the application of pulse waves, fluids, particle streams or other forces thereto, resulting in the sections of the sand mold being released and falling away from the casting.

In a further embodiment, a method and system of dislodging a mold from a casting can include placing one or more explosive charges or organic or thermally degradable materials at one or more selected locations within exterior walls, openings or recesses of the mold. The explosive charges are detonated at specific times in the process so as to cause the mold to fracture and break into pieces. The broken pieces may then be dislodged from the casting.

Additionally, score lines may be added to the mold containing the explosive charges or organic or thermally degradable or reactive materials. The score lines are operatively placed in combination with the explosive charge(s)

and/or organic or thermally degradable materials in predetermined locations to enhance the breaking down and dislodging of portions of the mold from the casting upon initiation of the explosive charge(s). After the mold has been dislodged, heat treatment of the casting may begin or continue.

Still a further embodiment includes a method and system for dislodging a mold and/or core from a casting by stimulating the mold with a high or low energy pulsation. The mold and/or core typically fracture or otherwise degrade after being stimulated or otherwise exposed to the high or low energy pulses or waves and the fractured portions of the molds and/or cores may then be dislodged from the casting. The energy pulsations typically include shockwaves, pressure waves, acoustical waves, electromagnetic waves or combination thereof produced from mechanical means, such as cannons or pressurized gas delivery systems, electromechanical means, microwaves and/or electromagnetic or other pulse wave generators. Additionally, score lines may also be applied to the mold to aid in breaking down and dislodging the mold from the casting.

The method and system of dislodging the molds and/or cores from castings can be utilized as part of an overall casting process in which the castings are poured and, after the castings have cooled to a sufficient amount to enable solidification of at least a portion of the outer surfaces of the casting, the molds can be dislodged prior to or in conjunction with an initial step of a solution heat treatment process for the castings. Thereafter, the dislodged sections of the molds and cores will be collected and subject to a reclamation process while the castings are heat treated. As a further alternative, the molds and cores can be broken up and dislodged from the castings after which the castings can be transferred to a quench tank in which the cores, which may be water soluble, can be broken down and removed, and/or the castings can then be subjected to an aging process as needed.

Typically, the pulse waves, fluids, particle streams, explosives or other forces applied to dislodge and/or break up the portions of the molds and to enhance breakdown of the sand cores within the castings will be applied in a chamber or along a transfer path from a casting station to a heat treatment, quenching, or aging line. To apply the pulse waves, fluids, particle streams, explosives or other forces, applicator mechanisms, such as pressure nozzles, acoustical or electromechanical shockwave generators or similar pulse generating mechanisms are positioned at spaced locations or stations and oriented or aligned with desired points about the molds, such as facing or aligned with score lines or joints in the molds. The molds generally are transported in known, indexed positions for directing pulse waves, such as blasts of pressurized fluids, particle streams, shockwaves, microwaves or other mechanical, electromechanical or electrical applications of force at desired points or locations such as along score lines found in the molds or at the connecting joints between sections of the molds to separate and break apart the molds into several larger chunks or pieces for more efficient and rapid removal of the molds therefrom. As the molds are broken down by the application of the pulse waves, fluids, particle streams, explosives or other forces, the sections or pieces of the molds are free to fall away from the castings for collection and reclamation. Accordingly, various materials collection and handling or conveying methods or systems can be used with the present invention, including rotary conveyors such as turntables, in-line conveyors, including both horizontal and vertically oriented conveying systems, flighted conveyors, indexing saddles, or similar mechanisms.

In further embodiments, the castings can be moved between indexed positions for the application of pulse waves, fluids, particle streams, explosives or other forces at desired locations by robot conveying mechanisms which can also be used to aid in the breaking apart and removal of the sections of the sand molds such as by physically engaging and removing portions of the molds. Alternatively, the castings and molds can be maintained in a substantially fixed position and applicators of pulse waves, fluids, particle streams or other forces can be moved to desired orientations thereabout.

Various objects, features and advantages of the present invention will become apparent to those skilled in the art upon reading the following specification, when taken in conjunction with the accompanying drawings.

DETAILED DESCRIPTION

The present invention generally comprises a method for enhancing the breakdown and removal of a mold and sand core from a casting formed within the mold to speed up the exposure of the casting to heat treatment temperatures and enhance the breakdown and reclamation of sand from the sand molds and sand cores. The mold may be removed from around its casting either prior to the introduction of the sand mold and casting into a heat treatment furnace or unit, or within the heat treatment furnace or unit itself for heat treatment and sand reclamation within the unit. Further, the system and method of the present invention for the enhanced breakdown and removal of a mold from a casting can be part of an overall or continuous metal casting and/or heat treatment process. The present invention also can be used as a separate or stand-alone process for removing the mold from "hot" (freshly poured and sufficiently solidified) and/or "cold" castings depending on the application. In use, the method of the present invention generally will be carried out when the molten metal of the castings has at least partially solidified along the outer surfaces of the castings to avoid deformation of the castings. The specifications of both U.S. Provisional Application Ser. Nos. 60/395,057 and 09/852,256 are by this reference incorporated herein in their entirety.

By enhancing the breakdown and removal of the molds from their castings, the castings are more rapidly exposed to the ambient heating environment of the heat treatment furnace or chamber. Less energy and time thus are required to increase the temperature of the casting to achieve the desired treatment and resulting metal properties of the casting when the mold is removed from the casting.

Metal casting processes are generally known to those skilled in the art and a traditional casting process will be described only briefly for reference purposes. It will also be understood by those skilled in the art that the present invention can be used in any type of casting process, including metal casting processes for forming aluminum, iron, steel and/or other types of metal and metal alloy castings. The present invention thus is not and should not be limited solely for use with a particular casting process or a particular type or types of metals or metal alloys.

Figure 1B:
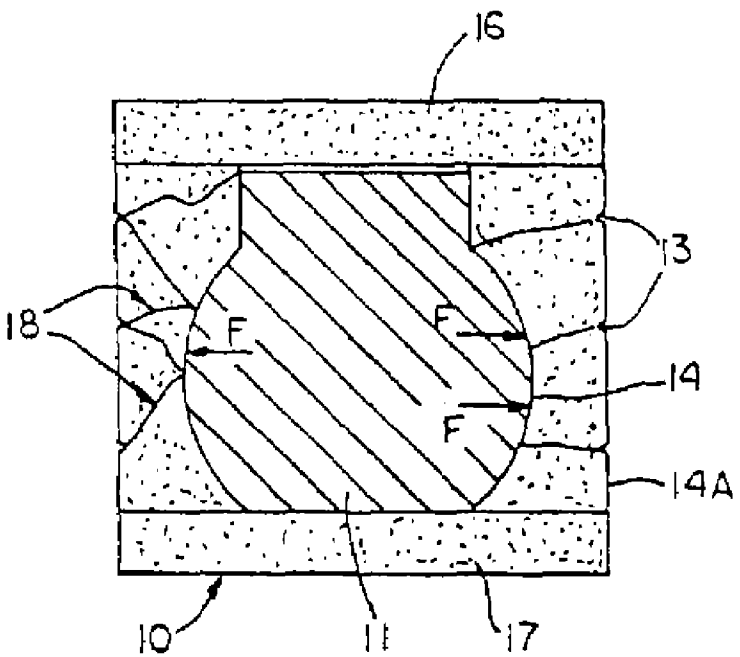
FIGS. 1A-1B are cross sectional views of a sand mold, illustrating the formation of score lines at desired locations thereon and the resultant fracture of the mold along the score lines.
Figure 1A:
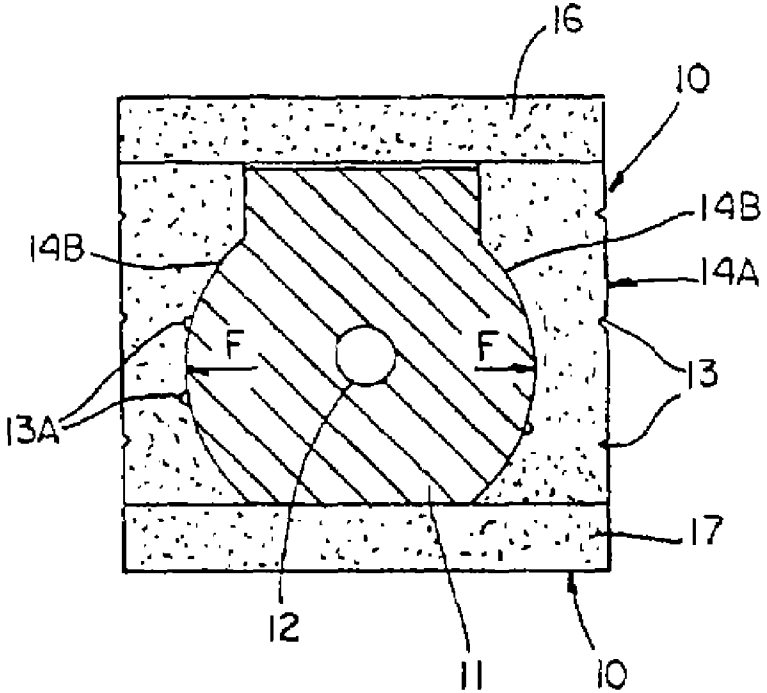

As illustrated in FIGS. 1A-1B, typically, a molten metal or metallic alloy is poured into a die or mold 10 at a pouring or casting station to form a casting 11, such as a cylinder head or engine block or similar cast part. Typically, casting cores 12 formed from sand and an organic binder, such as a phenolic resin, are received or placed within the molds 10, so as to create hollow cavities and/or casting details or core prints within the castings being formed within each mold. The casting cores can be separate from the molds or form parts of the molds. The molds typically can include "precision sand mold" type molds and/or "green sand molds," which molds generally are formed from a sand material such as silica sand or zircon sand, mixed with a binder such as a phenolic resin or other binder as is known in the art, similar to the sand casting cores 12. The molds further can include no-bake, cold box and hot box type sand molds as well as semi-permanent sand molds, which typically have an outer mold wall formed from sand and a binder material, a metal such as steel, or a combination of both types of materials. Still further, locking core type molds can be used, in which the molds are formed as interlocking pieces or sections that are locked together by a sand core. It will be,understood that the term "mold" will hereafter generally be used to refer to all types of molds and cores as discussed above.

The method of dislodging a mold from a casting can include "scoring" the sand mold and thus forming fault lines, indentations or weakened areas in the sand molds. The mold typically fractures and breaks along the score lines set into the mold as the binder material combusts to facilitate the dislodging and removal of the mold from the casting contained therein. The score lines generally are placed at predetermined locations along or about the sides and/or top and bottom of each mold, with these locations generally selected to be optimal for breaking down the mold. The placing of the score lines in such predetermined locations is dependent upon the shape of the mold and the casting formed within the mold.

The term "scoring" can include any type of cut, line, scratch, indentation, groove or other such markings made into the top, bottom and/or side walls of the mold by any mechanism including cutting blades, milling devices and other, similar automatically and/or manually operated cutting or grooving devices. The scoring generally may take place on the exterior of the mold, but is not limited only to the exterior surfaces of the mold, and it will be understood that the interior surfaces of the mold also can be scored or grooved, in addition to or alternatively of the scoring of the exterior surfaces. Each mold may be scored by any means such as by molded or scratched lines placed or formed on the exterior and/or interior surfaces of the mold during formation of the mold, or at some point thereafter, up to the introduction of the mold, with a casting therein, into a heat treatment furnace.

A force may further be applied to the mold to enhance the fracture and breaking of the mold into various pieces, which can then be easily dislodged or dropped away from the casting. Such a force may be applied to the inner walls of the mold, to the outer walls of the mold or a combination of the two. The force applied to, the inner walls of the mold typically results from the thermal expansion of the casting within the mold, with the expansion of the casting further being enhanced or accelerated by heating the casting using radiant energy, inductive energy or a combination thereof. The energy sources used to heat the casting may include electromagnetic energy, lasers, radio waves, microwaves and combinations thereof.

The energy sources used to heat the mold and/or casting also may include lasers, radio waves, microwaves, or other forms of electromagnetic energy and/or combinations thereof. In general, these and other energy sources are radiated toward the exterior or directed to specific areas of the mold or casting for the purpose of heating the mold and casting to cause thermal expansion leading to mold and/or core sand fracture or breakdown. Alternately, inductive energy generally involves enveloping the casting and mold in a field of electromagnetic energy which induces a current within the casting leading to the heating of the metal, and to a lesser degree, the mold. Typically, with the molds being insulative rather than conductive, inductive energy potentially offers some limited heating effect directly within the mold. Of course there may be other methods of heating and expanding the casting for fracturing the molding. Additionally, score lines can be added to the mold or by the mold itself to aid in the dislodging of the mold from the casting or mold.

Pulsations of energy also may be applied within specially designed process chambers such as for example a furnace. Design features may include the capability of withstanding pulsations and resultant effects, provide for the transportation of mold/casting into and out of the chamber to provide precise control of the pulsation. The energy pulsations generally enhance to some degree heat transfer to the mold cores and castings. The pulsations also promote mass transport of decomposed binder gases out of the mold and cores, oxygen bearing process gas to the mold and cores, and loosens sand out of the casting. The pulsations may occur at both low or high frequencies, where low frequency pulsations are generally utilized to generate a force for fracturing the mold or cores and the higher frequencies are employed to enhance the transfer, mass transport and some fracturing on a smaller scale. Higher frequency pulsations induce vibration effects to some degree within the casting to promote the mechanical effects of the above process.

Furthermore, the mold may be broken down by the application of any or all of these energy sources to the mold to promote the decomposition of the organic or thermally chemical binder of the sand mold and/or core, which binder breaks down in the presence of heat thus facilitating the degradation of the mold. Additionally, the mold may be broken down by the application of pressurized fluid(s) such as air, thermal oils, water, products of combustion, oxygen enriched gases, particle streams or other fluid materials to the exterior walls or openings or recesses in the walls of the mold.

Furthermore, a direct application of force in the form of pulses or shockwaves, application of pressurized fluids, acoustical waves, or other mechanical, electromechanical or electromagnetic pulses, or a combination thereof can be applied to the mold, cores, or casting to aid in fracturing and breaking the mold into pieces. In one embodiment, the mold and/or core is stimulated with a high energy pulsation for direct application of a force, which may also penetrate the walls of the mold and cause heating of the mold to further aid in the combustion of the mold binder and the resultant breaking down of the mold. The pulsation energy may be a constantly recurring or intermittent force or pulses and can be in the form of shockwaves, pressure waves, acoustical waves, or any combination thereof produced by mechanical, electromechanical, electrical and/or other known means such as compression cannons or pressurized gasses. Such energy pulsations or force applications are collectively referred to hereinafter as "pulse waves," which term will be understood to cover the above-described energy pulsations and other known mechanical, electrical and electromechanical force applications. Alternatively, low power explosive charges or organic or thermally degradable materials can be placed in the mold and set off or initiated by the heating of the mold to assist in break up and dislodging of the mold from about its casting.

In greater detail, the present invention envisions several alternative embodiments and/or methods for performing this function of dislodging or breaking up the sand molds prior to or during heat treatment of the castings. It will also be understood that any of the described methods can be used in conjunction with or separately from one another. These various methods are illustrated in FIGS. 1A through 6B.

In a first embodiment of the invention illustrated in FIGS. 1A and 1B, a sand mold 10 with a casting 11 therein is shown with at least one, and typically multiple, score lines 13 or relief lines formed in the exterior side walls 14A of the mold 10. The score/relief lines 13 typically will be cut or otherwise formed as grooves or notches in the exterior side walls 14A of the mold 10 and act as break lines for the exterior walls of the mold pack. It is also possible to cut or form the score/relief lines 13A in the interior walls 14B of the mold 10 as shown in FIG. 1A and/or in the top and bottom walls 16 and 17 of the mold 10.

As further illustrated in FIG. 1B, these score/relief lines weaken the mold walls so as to predetermine the locations and positions of the fracture or breaking apart of the mold 10, such that as a force F is applied to the walls 14B of the mold 10, the walls 14B of the mold 10 are caused to crack and break apart along these score/relief lines as illustrated at 18 in FIG. 1B. Typically, this force F includes the exertion of pressure against the interior walls 14 of the mold 10 by the casting 11 itself due to the thermal expansion of the metal of the casting 11 as it is subjected to heating or elevated temperatures for heat treating the casting. As the metal of the casting expands in response to heat in the heat treatment furnace, it presses against and urges the walls 14B of the mold 10 outwardly, causing the mold 10 to crack and break apart at the points of weakness therein created by the score/relief lines 13. As a result, sections or portions of the mold 10 will be readily and easily dislodged from the mold 10 and its casting generally prior to or during an initial phase of the heat treatment process for the casting, rather than the mold simply breaking down and slowly degrading as its binder material is combusted over time in the heat treatment furnace.

Figure 2B:
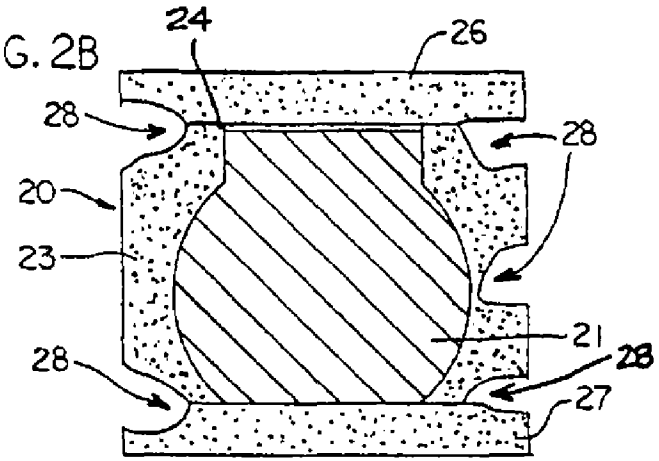
FIGS. 2A-2B are cross sectional views of a sand mold and casting, illustrating the use of score lines and explosive charges placed within the sand mold and fracture and dislodging of the mold upon initiation of the explosive charges.
Figure 2A:
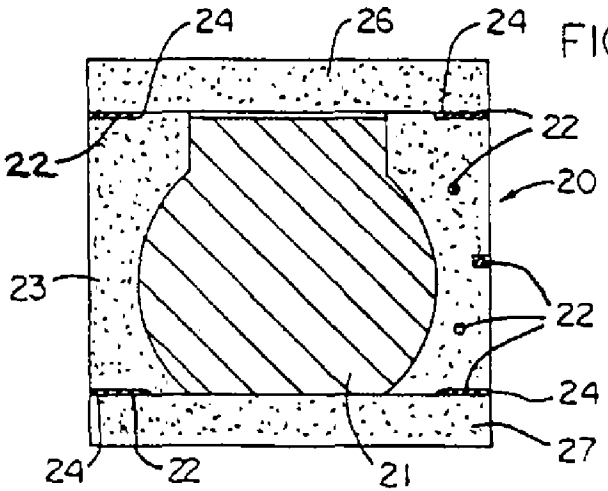

FIGS. 2A-2B illustrate an alternative embodiment of the present invention for breaking down and dislodging a mold 20 from a casting 21 formed therein. In this alternative method, low impact explosive charges 22 are mounted at one or more points within the side walls 23 of the mold 20. The explosive charges 22 generally are strategically located within the mold pack, generally near critical joints 24 within the walls, such as between the side walls 23 and the top and bottom walls 26 and 27, so as to dislodge the mold 20 from the casting 21, while still retaining the casting 21 intact. As additionally shown in FIG. 2B, after explosion of the low intensity explosive charges 22, gaps or channels 28 are formed in the mold 20, extending deeply through the side walls 23 and upper and lower portions or walls 26 and 27 of the mold 20. As a result, the mold 20 is substantially weakened at or along these channels or gaps 28 such that the mold 20 tends to readily break apart in sections or pieces along these channels 28 in response to presence from the thermal expansion of the casting 21 and/or as the binder materials of the mold 20 is combusted for ease of removal of the mold 20 from its casting 21.

Figure 3:
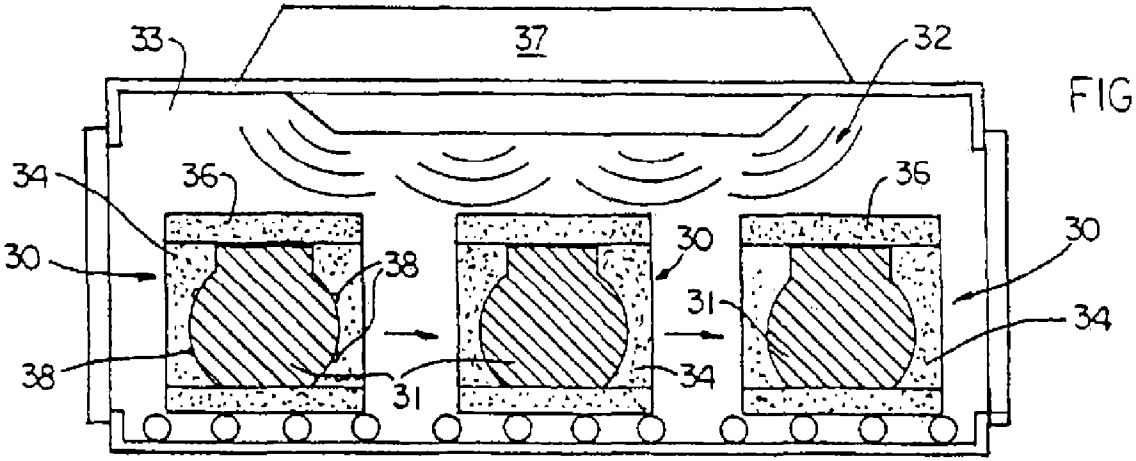
FIG. 3 depicts a cross sectional view of a mold passing though an energy pulse chamber within or adjacent a treatment furnace, illustrating the mold pack and casting being treated with energy pulses.

Still a further embodiment of the present invention for breaking apart and enhancing the removal of a mold 30 and from a casting is illustrated in FIG. 3. In this embodiment of the present invention, vibratory forces to promote fracture of mold/core sand are applied to the molds by high-energy and/or low energy pulses or waves 32 which are directed at the molds 30 as they are passed through a process-chamber 33, which typically is positioned in front of or at the input end of a heat treatment furnace so that the molds and castings generally pass therethrough prior to heat treatment of the castings. The pulses 32 generally will be of variable frequencies and/or wavelengths and are typically directed at the side walls 34 and/or upper portions or top walls 36 of the molds from one or more pulsation or wave generators 37 mounted within the chamber. Such energy pulsations or waves 32 typically can be generated in the form of shock waves, pressure waves, or acoustical waves propagated through the atmosphere of the process chamber 33. Alternatively, electromagnetic energy can be pulsed or radiated at or against the walls of the molds 30 as described to promote fracture, heat absorption, binder degradation, or other process effect for the purpose of dislodging mold and core sand from the casting. Such electromagnetic radiation would be in the form of lasers, radio waves, microwaves, or other forms result in the, process effects described above.

The energy pulses directed towards the molds stimulate the molds and cause them to vibrate without requiring physical contact with the mold packs. As the pulsations pass through the molds, the stimulation and vibration of the molds tends to cause fracturing and breaking apart of the molds. The pulsation may be either a sustained pulse or directed as discrete pulses. The discrete pulses may be administered at regular intervals. Pulsations administered in sustained or discrete fashion would be carefully controlled in terms of frequency, interval of application, and intensity, so as to accomplish the process effects without harming the casting. In addition, the molds can also be scored or pre-stressed/weakened, at selected points as discussed above and as indicated at 38 in FIG. 3, so as to facilitate or promote the breaking apart of the molds as they are vibrated or otherwise impacted by the high energy pulses.

The molds accordingly are caused to be broken down and dislodged from their castings as the castings are moved into a heating chamber of the heat treatment furnace or other processing of the castings. In addition, as discussed in U.S. patent applications Ser. Nos. 09/627,109, filed Jul. 27, 2000, and Ser. No. 10/066,383, filed Jan. 31, 2002, the disclosures of which are incorporated herein by reference in their entirety, the energy pulses further typically cause the castings within the molds to be heated, which further results in thermal expansion of the castings so as to apply a force against the interior side walls of the molds to further facilitate and enhance the breaking apart of the molds.

Figure 4A:
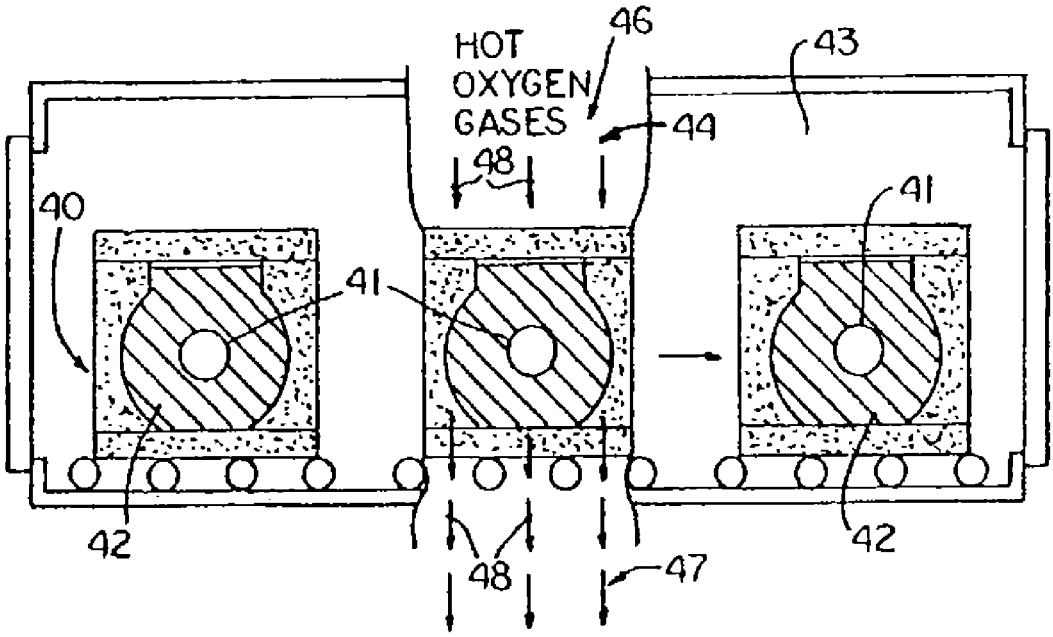
FIGS. 4A-4B illustrate movement of the molds through an oxygen enriched chamber for applying a flow of oxygen to promote combustion of the organic or thermally degradable binder of the molds.
Figure 4B:
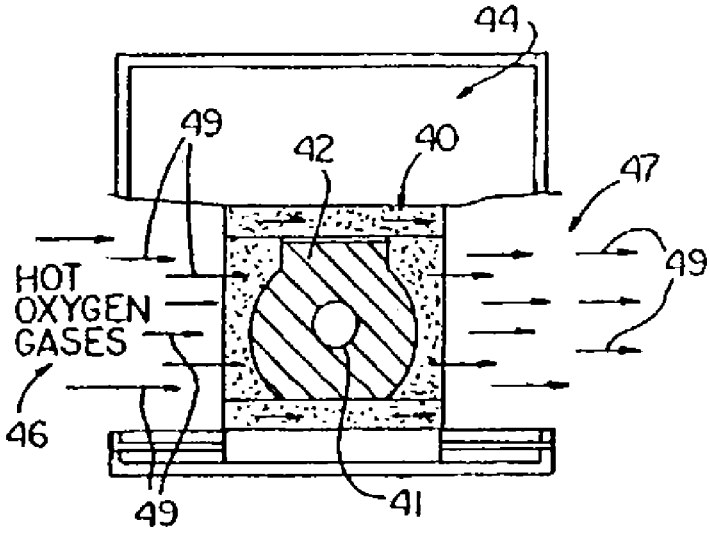

FIGS. 4A-4B illustrate an alternative embodiment of the present invention for heating and enhancing the breakdown and removal of molds 40 and potentially the sand cores from castings 42 contained within the molds. In this embodiment, prior to or as the molds 40 and their castings 42 are moved into a heat treatment furnace or chamber 43, they are passed through a low velocity oxygen chamber 44. The oxygen chamber generally is an elongated autoclave or similar pressurized heating chamber capable of operating under higher than ambient pressures. The oxygen chamber 44 is provided with an enriched oxygenated environment and includes a high pressure upstream side 46 and a low pressure downstream side 47 that are positioned opposite each other to assist in drawing an oxygen flow therebetween.

As the molds are passed through the low velocity oxygen chambers of the heating chamber 44, heated oxygen gas is directed at and is forced through the molds, as indicated by arrows 48 (FIG. 4A) and 49 (FIG. 4B). The oxygen gas is drawn or flows under pressure from the high atmospheric pressure side to the low atmospheric pressure side of the oxygen chamber, so that the oxygen gas is urged or forced into and possibly through the molds and/or cores. As a result, a percentage of the oxygen gas is combusted with the binder materials of the sand molds/cores, so as to enhance the combustion of the binder materials within the heating chamber. This enhanced combustion of the binder materials of the molds and cores are further supplied with energy from the enhanced combustion of the binder material thereof and the oxygen, which helps enhance and/or speed up the breakdown and removal of the molds from their castings. This breakdown of the molds can be further assisted by scoring or forming relief lines in the molds, as discussed in greater detail above, so as to pre-stress/weaken the molds. As a result, as the binder materials are combusted, the mold walls will tend to crack or fracture so that the molds will break and fall away from their castings in sections or pieces.

In addition, the enhanced combustion of the binder materials can serve as an additional, generally conductive heat source to thus increase the temperature of the castings in the molds and facilitate combustion of the binder materials of the sand cores for ease of removal and reclamation. As a result, the castings are raised to their heat treatment temperatures more rapidly, which helps reduce the residence time of the castings in the heat treatment furnace that is required to properly and completely heat treat the castings, as discussed in copending U.S. patent applications Ser. Nos. 09/627,109, filed Jul. 27, 2000, and Ser. No. 10/066,383, filed Jan. 31, 2002.

Figure 5C:
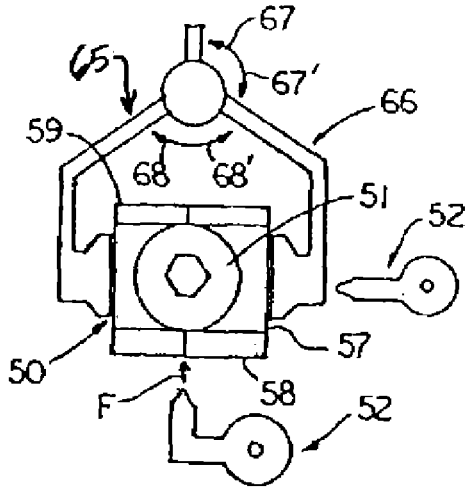
FIGS. 5A-5C illustrate the application of pulse waves to a mold for breakdown of the mold.
Figure 5A:
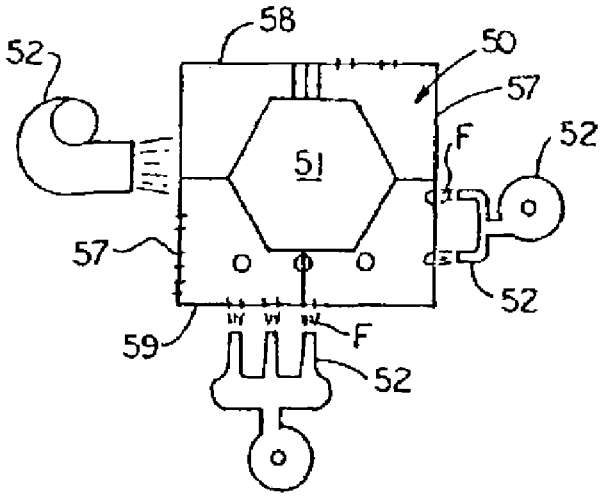
Figure 5B:
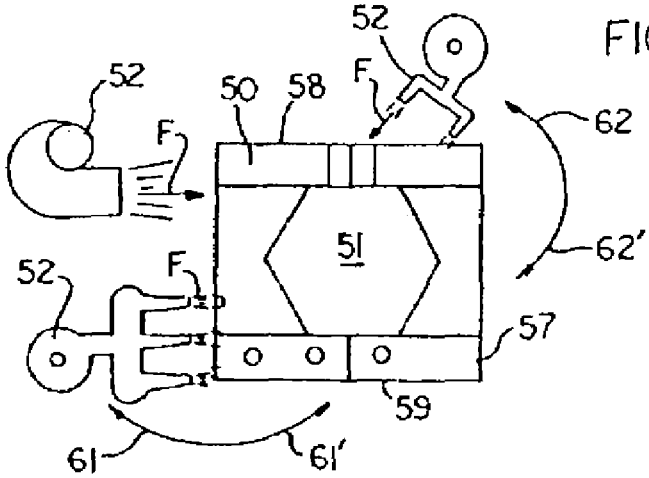

Still a further embodiment of the present invention for enhancing the breakdown and removal of a sand mold 50 and potentially for breakdown and removal of a sand core located within the casting from a casting 51 formed or contained within the mold is illustrated in FIGS. 5A-5B. In this embodiment, a series of pulse wave generators or force applicators 52, such as air cannons, fluid nozzles, acoustic wave generators or other mechanical and/or electromechanical mechanisms generally are positioned at specific locations or positions along the path of travel (arrow 53 in FIG. 6A) of the mold/core laden casting into or within a heat treatment furnace, either as a part of the heat treatment furnace, such as in an initial, prechamber of the furnace, or within a mold breakdown or process chamber 54 generally positioned in front of or upstream from the heat treatment furnace, to aid in the removal of the sand core from the castings. Such force or pulse wave applications will be applied at a point after the outer surfaces of the castings contained within the molds have had a chance to solidify to an extent sufficient to prevent or avoid deformation or damage to the outer surfaces of the castings by the application of such forces or pulse waves.

The number of pulse generators or force applicators 52 (hereinafter "applicators") can vary as needed, depending upon the core print or design of the casting being formed in the mold such that different types of castings having differing core prints can utilize an optionally different arrangement or number of applicators within the chamber. As indicated in FIG. 5A, each of the applicators 52 generally is mounted within the interior 56 (FIG. 6B) of the process chamber 54, oriented at known or registered positions with respect to the side walls 57 (FIGS. 5A-5B), top or upper walls 58 and/or lower or bottom walls 59 of the molds 50 corresponding to known, indexed positions of the cores and castings. For example, the applicators 52 can be mounted at spaced locations along the length of chamber 54 (FIG. 6A) or along path of travel of the molds and castings, so that the molds will be engaged at varying points along their path of travel, within different applicators directed toward the same or different core openings, joints or score lines formed in the molds. As the molds are moved along the chamber 54, the applicators apply forces, such as fluids, particle streams, pulse waves and other forces, against the joints or score lines of the molds to physically cause fracturing and/or breaking apart of the molds.

The applicators also may be automatically controlled through a control system for the heat treatment station or furnace that can be operated remotely to cause the nozzles to move to various desired positions about the side walls 57 and top and bottom walls 58 and 59 of the mold as indicated by arrows 61 and 61' and 62 and 62' in FIG. 5B. As a further alternative, as illustrated in FIG. 5C, the molds 50 can be physically manipulated or conveyed through the process chamber by a transfer mechanism 65 (FIG. 5C) such as a robotic arm 66, or an overhead hoist or conveyor or other similar type of transport mechanism in which the castings are physically engaged by the transport mechanism, which also can be used to rotate the molds with their casings therein as indicated by arrows 67 and 67' and 68 and 68'. As a result, the molds can be reoriented with respect to one or more applicators 52, so as to be rotated or otherwise realigned into known, indexed positions such that score lines formed in the molds or joints formed between sections or pieces of the molds are aligned with applicators 52 for the directed application of force or pulse waves thereto to facilitate breaking apart and dislodging of pieces of the molds from their castings. Still further, the robot arm or other transfer mechanism further could be used to apply a mechanical force directly to the molds, including picking up or pulling sections or portions of the molds away from the castings or otherwise engaging the molds. Such mechanized application of force to the molds can also be applied in conjunction with other applications of force or the heating of the sand molds to cause the more rapid fracture and dislodging of pieces of the sand molds from their castings.

Figure 6A:
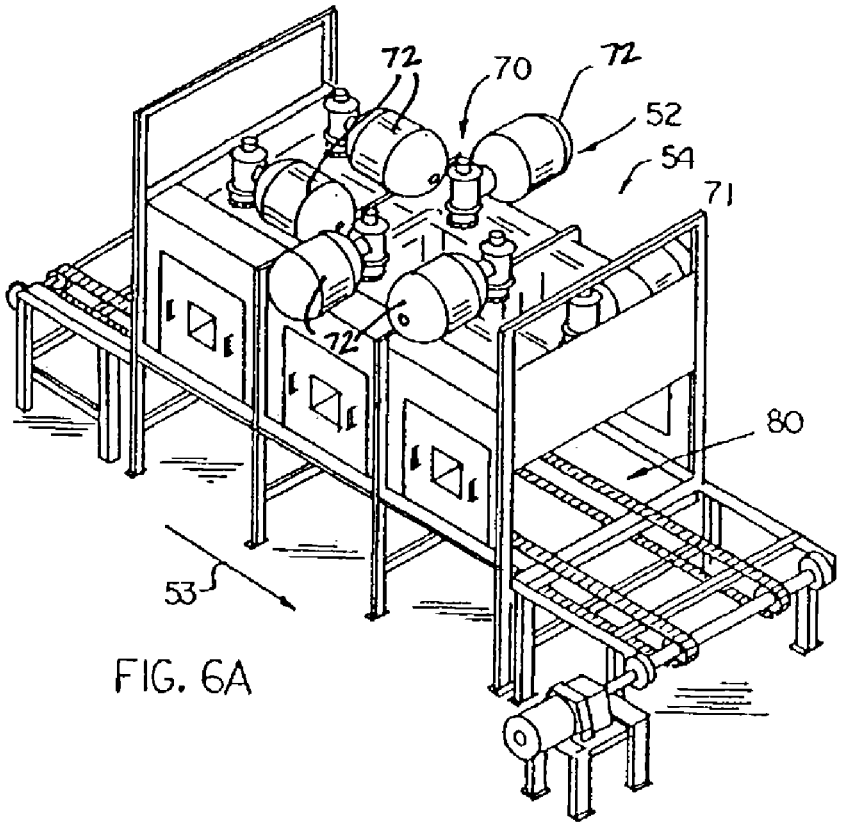
FIGS. 6A-6B illustrate an example embodiment of a chamber or unit for application of pulse waves to the molds.
Figure 6B:
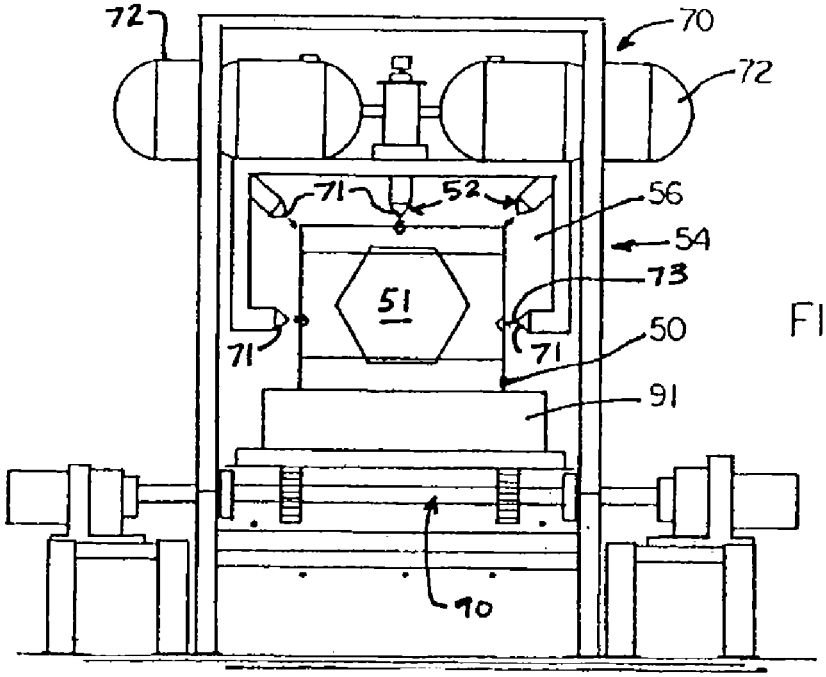

FIGS. 6A and 6B illustrate an example embodiment of a mold breakdown or process chamber 54 of the present invention for the rapid breakdown and dislodging of the sand molds in significantly larger pieces or sections to facilitate the more rapid removal of the molds from their castings. In this embodiment, the applicators 52 are illustrated as cannons 70 or fluid or particle applicators that direct flows or pulses of a high-pressure fluid or particle media through a series of directional nozzles or applicators 71. Each of the nozzles 71 generally is supplied with a high-pressure heated fluid media such as air, thermal oils, water or other known fluid materials or particles, such as sand from storage units such as pressurized tanks 72, pumps or compressors connected to the nozzles or applicators 71. As indicated in FIG. 6B, the nozzles 71 direct pressurized fluid flows, indicated by arrows 73 at the side walls, top wall and/or bottom wall of each mold/core.

These pressurized fluid or particle flows are converted to high fluid velocities at the exit openings of the nozzles, which enhances the energy of the fluid flow applied to the mold/core so as to apply forces sufficient to at least partially fracture and/or otherwise degrade the mold and/or cores. Such high fluid velocities further typically cause or promote higher heat transfer to the casting, mold, and cores which has added benefit in breaking down mold and sand core. The pressurized fluid flows, which are administered by the nozzles, can be applied in continuous flows or as intermittent blasts or pulse waves that impact or contact the mold walls to cause the mold walls to fracture or crack and can promote more rapid decomposition and/or combustion of the binder materials of the molds, and potentially the sand cores, to help at least partially degrade or break down the molds. These fluid flows are applied under high pressure, in the range of about 5 psi to about 200 psi for compressed air pulses, about 0.5 psi to about 5000 psi for fuel fired gas and air mix pulses, and about 0.1 to about 100 psi for mechanically generated gaseous pulses, although greater or lesser pressures also can be used as required for the particular casting application. For intermittent pulses, such pulses typically will be applied at a rate of about 1-2 pulses per second up to one pulse every several minutes. In addition, the pressurized fluid flows can be directed at score lines or joints formed in the molds to facilitate breakup of the molds.

For example, utilizing a process chamber such as depicted in FIGS. 6A and 6B, a series of molds generally will be indexed through the chamber 54 at approximately 1 to 2 minute intervals, through approximately five inline positions or stations, with the molds being treated at each position over approximately 1 to 2 minute intervals, although greater or lesser residence times also can be used. Such inline stations or positions generally can include loading, top removal, side removal, end removal (and possibly bottom removal) and an unloading station with the top side and end (and possibly bottom) removal stations generally being located within the interior of the process chamber sealed within blast doors at each end. Fewer or a greater number of stations or positions having varying applicators also can be provided as desired.

As indicted in FIG. 6A, the chamber 54 generally will include up to six pulse generators, although fewer or greater numbers of pulse generators also can be used. The pulse generators will deliver a high pressure blast or flow or air directed at desired mold joints and/or, if so provided, score lines formed in the molds. Typically, each of the pulse generators will deliver approximately 30 to 40 cubic feet of air/gas at approximately 70 to 100 psig per charge or pulse for compressed air, which pulses generally will be delivered at approximately 1 minute firing intervals, although greater or lesser firing intervals also can be used, so as to deliver approximately 200 to 250 cfm of air up to about 300 cfm or more of a gas-air mixture to the mold joints and/or score lines.

Typically, a screw-type or scroll compressor can be used to supply the air directly to the pressurized tanks of the pulse generators on a substantially continuous basis. For example, a 50 to 100 hp. compressor can be used to supply a sufficient amount of compressed air to process approximately 50-100 molds per hour. For gas-air fired pulses/fluid flows, power requirements generally range from about 2-75 hp. In addition, the nozzles of the pulse generators can be externally adjustable by moving the generator mounts in at least two dimensions, with the nozzles or applicators of the pulse generators generally being pre-configured to accommodate desired or specified mold packages. In addition, although the pulse generators are indicated in FIG. 6A as being mounted on top of the process chamber, it also is envisioned that there are other types of pulse generators, besides compressed air generators or applicators, that can be used and that the pulse generators can be positioned along the sides and/or adjacent the bottoms or ends of the process chamber.

The molds generally will be indexed through the inline positions, such as at a nominal index speed of approximately 30 to 40 feet per minute, although varying indexing speeds are envisioned depending upon the size and configuration of the sand molds. The indexing motion and pulse firing of the pulse generators generally will be controlled according to safety interlocks by a computer control system, such as a PLC control or a relay logic type control system. As the molds break apart, the fragments or sections of the molds generally will fall into collection shoots located below the chamber, which will direct the collected fragments toward feed conveyors for removal of the fragments. Thereafter, the recovered fragments of the molds can be pulverized for reclamation or passed through magnetic separation means to first remove chills and the like therefrom after which the sand molds then can be passed to reclamation for later reuse. Additionally, excess gases or fumes can be collected and exhausted from the process chamber and sand conveyors.

Figure 8A:
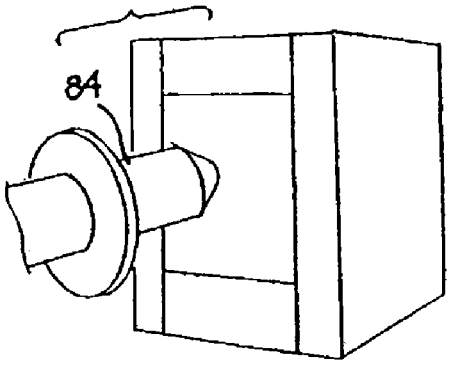
FIGS. 8A-8D illustrate a series of steps in the demolding of a casting, according to an embodiment of the present invention.
Figure 8B:
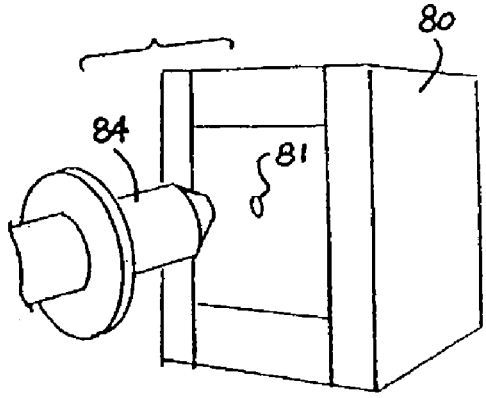
Figure 8C:
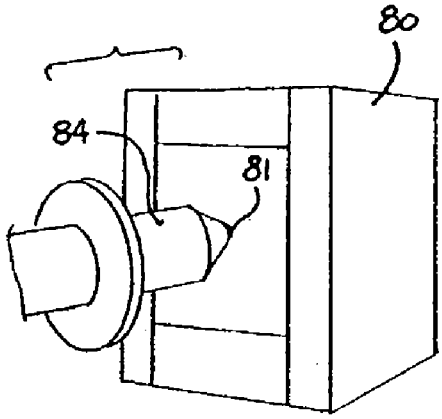
Figure 8D:
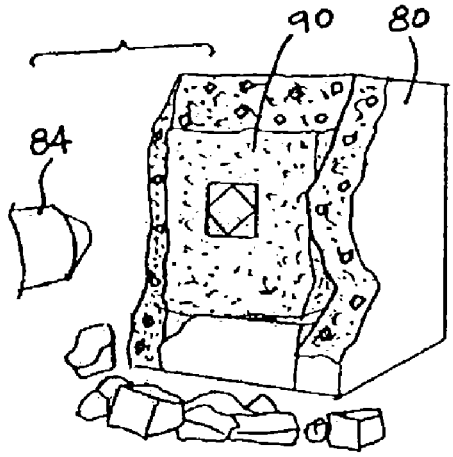

FIGS. 8A-8D show the application of pulse waves to a mold 80 and the resultant dislodging of sections of the mold from the casting 90. As shown, a pulsed wave applicator 84 is brought into proximity with the mold 80. A pulsed wave of electromagnetic energy, fluid or particles is directed at a wall of the mold 80, thereby forming a hole 81 therein. Further, pulsed wave energy or fluid then is directed at the mold 80 to cause at least a portion of the mold 80 to break into pieces. FIG. 8D shows part of the casting 90 exposed after the mold 80 has been partially broken apart.

As further indicated in FIGS. 6A and 6B, the present invention can utilize a variety of different types of conveying mechanisms for moving the sand molds with their castings therein into known, indexed positions as desired or needed for application of pulse waves or other direct force applications thereto, such as along score lines or joint lines between the sections of the molds. Such conveying mechanisms include indexing conveyors or chain conveyors 80, as indicated in FIG. 6A, and which can include locator pins or other similar devices for fixing the position of the molds on the conveyors, indexing saddles such as disclosed in U.S. patent applications Ser. Nos. 09/627,109, filed Jul. 27, 2000 and Ser. No. 10/066,383, filed Jan. 31, 2002, overhead crane or boom type conveyors, robotic transfer arms or similar mechanisms, as well as flighted conveyors 90, in which the molds are contained within flights or sections 91 of the conveyor such as indicated in FIG. 6B. It is also possible for the chamber to be oriented horizontally or vertically as desired.

Still further, in all the embodiments of the present invention, the applicators and conveying mechanisms are generally positioned or mounted within the chamber in such a fashion so that they will not interfere with the dislodging of the pieces of the molds from their castings so as to enable the mold pieces to fall away under force of gravity away from their castings without interference. Alternatively, the transport or other mechanized systems or mechanisms, such as a robot arm, can physically remove and transport pieces or sections of the molds away from the castings and deposit them at a collection point such as a bin or transport conveyor.

Figure 7:
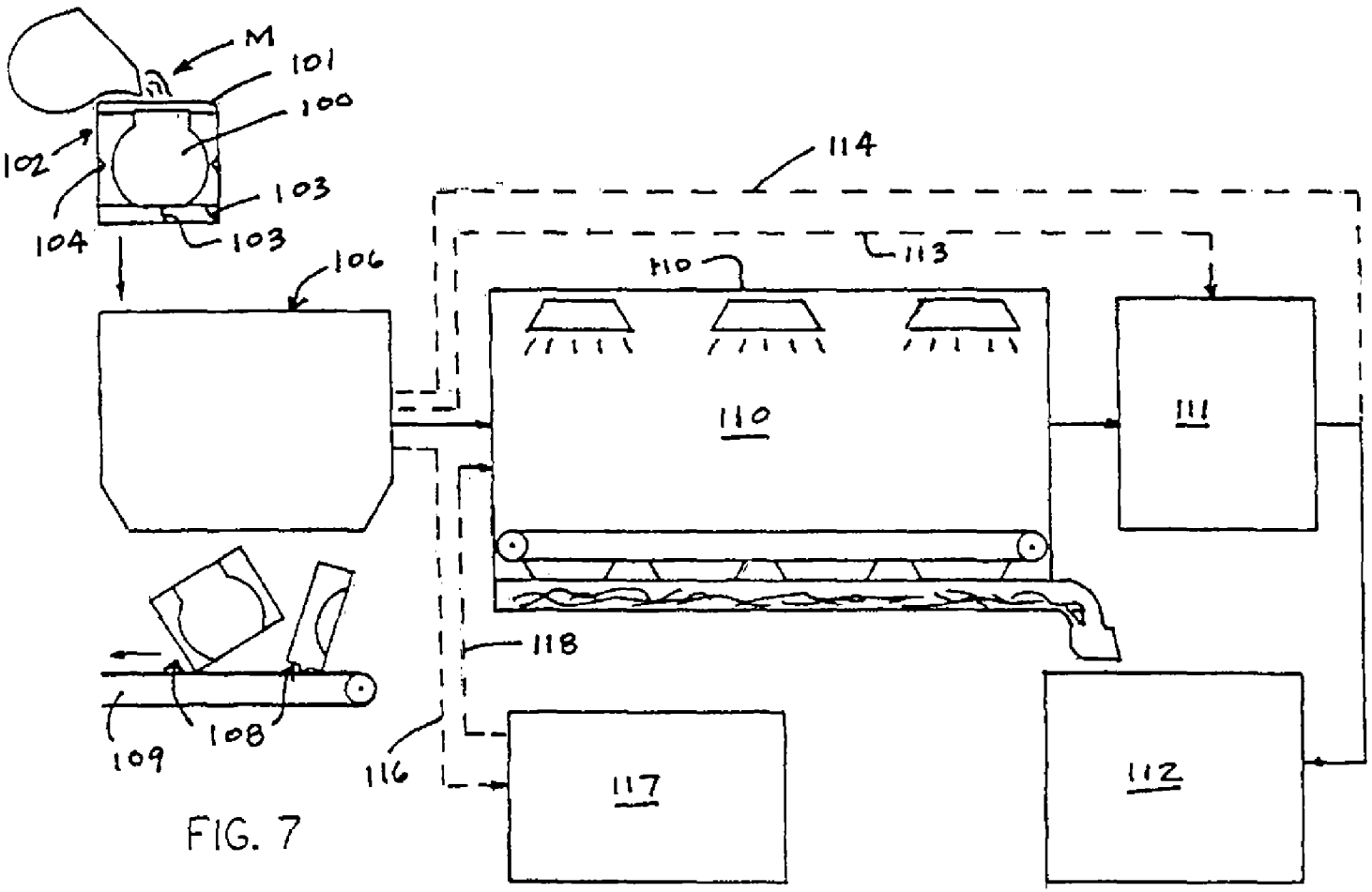
FIG. 7 is a schematic illustration of the application of the present invention as part of an overall casting process.

The method of the present invention typically will be used to break down and enhance the removal of sand molds from metal castings as a part or step in an overall or continuous casting process in which the metal castings are formed from molten metal and are heat treated, quenched and/or aged or otherwise treated or processed, as indicated in FIG. 7. As FIG. 7 illustrates, the castings 100 will be formed from a molten metal M poured into a mold 101 at a casting or pouring station 102. Typically, the mold 101 will be formed in sections along joint lines 103, and further can include score lines or indentations formed in portions of the outer walls of the molds, as indicated at 104.

After pouring, the molds, with their castings contained therein, generally will be conveyed or transferred to a mold breakdown or process chamber, indicated at 106. Within the mold breakdown or process chamber 106, the molds generally are subjected to applications of forces or pulse waves, as discussed with respect to FIGS. 5A-6B, high or low energy pulsations (FIG. 3), and/or application or oxygenated air flows (FIGS. 4A-4B) so as to enhance and promote the rapid break down or fracturing and removal of the sand molds in fragments or sections 108 from the castings. Typically, the fragments 108 of the sand molds that are broken down are dislodged in the mold break down or process chamber 106 are allowed to fall through a collection chute downwardly to a transport conveyor 109 or into a collection bin for transferring or conveying away of the pieces for reclamation and/or chill removal.

Thereafter, as indicated in FIG. 7, the castings, with the molds having been substantially removed therefrom, generally are introduced directly into a heat treatment unit, indicated at 110 for heat treatment, and which further can complete any additional mold and sand core break down and/or sand reclamation in addition to solution heat treatment such as disclosed in U.S. Pat. Nos. 5,294,994, 5,565,046, 5,738,162, 5,957,188, and 6,217,317, and currently pending U.S. patent application Ser. No. 10/066383, filed Jan. 31, 2002, the disclosures of which are incorporated herein in their entirety by reference. After heat treatment, the castings generally are passed into a quench station 111 for quenching and can thereafter be passed or transferred to an aging station indicated at 112 for aging or further treatment of the castings as needed or desired.

Alternatively, as indicated by dashed lines 113 in FIG. 7, following breakdown and removal of the molds from their castings, the castings can be transferred directly to the quench station 111 without requiring heat treatment. The disintegration and removal of the cores can be completed within the quench station, i.e., the cores, which may be water soluble, are immersed in or sprayed with water or other fluids so as to cause the cores to be further broken down and dislodged from the castings. As still a further alternative, as indicated by dashed lines 114, if so desired, the castings can be taken from the mold breakdown of chamber 106 directly to the aging station 112 for aging or other treatment of the castings if so desired.

In addition, as further indicated in FIG. 7, following the breakdown and removal of the molds from their castings, the castings can be transferred, as indicated by dashed lines 116, to a chill removal/cutting station 117 prior to heat treatment, quenching and/or aging of the castings. At the chill removal/cutting station 117, any chills or other relief forming materials generally will be removed from the castings for cleaning and reuse of the chills. The castings also can be further subjected to a sawing or cutting operation in which risers or other unneeded pieces that are formed on the castings will be cut away from the castings and/or the castings subjected to a degating operation. The removal of the risers or other unneeded metal or pieces of the castings helps promote quenching and reduces the amount of metal of the castings that must be treated or quenched so as to reduce in furnace and/or quench time. After removal of chills and/or cutting away of the risers or other unneeded pieces of the castings, the castings generally are returned to the process/treatment line such as being introduced into the heat treatment unit 110, as indicated by dash lines 118, although it will also be understood by the skilled in the art that the castings can thereafter be taken directly to the quench station 111 or to the aging station 112 as needed for further processing.

It will also be understood by the skilled in the art that the present invention, while enhancing the breakdown and removal of molds from their castings, further enables the enhanced breakdown and removal of the sand cores from castings. For example, as the castings are heated through being subjected to high energy pulsations, as discussed with respect to FIG. 3, or as the combustion of the binder materials for the molds of the castings is enhanced or promoted through the application of oxygenated air flows thereto, the sand cores likewise will be heated and their binder materials caused to combust to more rapidly breakdown the sand cores for ease of removal as the molds or mold pieces are dislodged from the castings.

Still further, pulse waves or force applications can be directed at core openings formed in the molds so as to be directed at the sand cores themselves to enhance the breakdown of the sand cores for ease of removal from the castings. Accordingly, the present invention can be used with conventional locking core type molds in which the cores form a key lock that locks the sections or pieces of the molds together about the casting. Utilizing the principles of the present invention, energy pulsations or applications of pulse waves or force can be directed at such locking cores to facilitate the breakdown and/or disintegration of the locking cores. As a result, with the destruction of the locking cores, the mold sections can be more easily urged or dislodged from the castings in larger sections or pieces to facilitate the rapid removal of the molds from the castings.

It will be understood by those skilled in the art that while the present invention has been disclosed above with reference to preferred embodiments, various modifications, changes and additions can be made to the foregoing invention, without departing from the spirit and scope thereof.

What is claimed is:

1. A method of removing a mold from a casting formed therein, comprising:

subjecting the mold to a process to fracture the mold;

directing an energized stream at the mold to cause the mold to degrade; and dislodging at least a portion of the degraded mold from the casting.

2. The method of claim 1, wherein said step of subjecting comprises scoring the mold by forming score lines in exterior walls of the mold.

3. The method of claim 2, wherein the score lines are placed in predetermined locations to aid breaking down and dislodging portions of the mold from the casting.

4. The method of claim 1, wherein said step of subjecting comprises thermally expanding the casting to cause the casting to bear against the mold.

5. The method of claim 4, wherein the casting is expanded by heating the casting.

6. The method of claim 5, wherein the casting is heated by an energy source selected from the group consisting of radiant energy, inductive energy and combinations thereof.

7. The method of claim 6, wherein the energy source is selected from the group consisting of electromagnetic energy, lasers, radio waves, microwaves, and combinations thereof.

8. The method of claim 1, wherein the mold is formed from sand and a degradable binder and wherein said step of subjecting comprises combustion when the mold is heated under elevated pressures in an enriched oxygen atmosphere to facilitate breakdown of the mold.

9. The method of claim 1, wherein at least a portion of the degraded mold is dislodged from the casting prior to heat treating the casting.

10. The method of claim 1, wherein the energized stream comprises a pressurized fluid.

11. The method of claim 10, wherein the pressurized fluid comprises heated air, thermal oil or water.

12. A method of dislodging a mold from a casting formed therein, comprising:

directing an energized stream at the mold, wherein the energized stream comprises an explosive charge detonated at a selected location within exterior walls of the mold;

subjecting the mold to a process to fracture the mold; and dislodging at least a portion of the mold from the casting.

13. The method of claim 12, wherein the mold is comprised of sand and a binder.

14. The method of claim 12, wherein said step of subjecting comprises scoring the mold by forming score lines in exterior walls of the mold.

15. The method of claim 14, wherein the score lines are operatively placed in combination with the explosive charge in predetermined locations for breaking down and dislodging portions of the mold from the casting.

16. The method of claim 12, wherein at least a portion of the mold is dislodged from the casting prior to heat treating the casting.

17. The method of claim 12, wherein said step of subjecting comprises heating the casting to cause expansion of the casting.

18. The method of claim 17, wherein heating the casting comprises applying energy to the casting from an energy source selected from the group consisting of radiant energy, inductive energy and combinations thereof.

19. The method of claim 18, wherein the energy source is selected from the group consisting of electromagnetic energy, lasers, radio waves, microwaves, and combinations thereof.

20. The method of claim 12, and wherein the mold is formed from sand and a degradable binder that is combusted in said step of subjecting as the mold is heated under elevated pressures in an enriched oxygen atmosphere to facilitate breakdown and dislodging of the mold from the casting.

21. The method of claim 12, wherein said process comprises directing a pressurized fluid at exterior walls of the mold.

22. The method of claim 21, wherein the pressurized fluid comprises heated air, thermal oil or water.

23. A method of dislodging a mold from a casting formed therein, comprising:

stimulating the mold with an energy pulsation;

subjecting the mold to a process to assist fracturing the mold; and dislodging the mold from the casting.

24. The method of claim 23, wherein the energy pulsation is applied as a shock wave.

25. The method of claim 24, wherein the shock wave is produced from at least one of the following: mechanical means, cannons, pressurized gasses and electromechanical means, and a combination thereof.

26. The method of claim 23, wherein said step of subjecting comprises scoring the mold by forming score lines in exterior walls of the mold.

27. The method of claim 26, wherein the score lines are operatively placed in predetermined locations for breaking down and dislodging portions of the mold from the casting.

28. The method of claim 23, wherein said step of subjecting comprises heat treating and pieces of the mold are dislodged from the casting prior to heat treating the casting.

29. The method of claim 23, wherein said step of subjecting comprises heating the casting so as to cause the casting to expand.

30. The method of claim 29, wherein heating the casting comprises applying energy to the coating from an energy source selected from the group consisting of radiant energy, inductive energy and combinations thereof.

31. The method of claim 30, wherein the energy source is selected from the group consisting of electromagnetic energy, lasers, radio waves, microwaves, and combinations thereof.

32. The method of claim 23, and wherein the mold is formed from sand and a degradable binder and said step of subjecting comprises combusting the binder as the mold is heated under elevated pressures in an enriched oxygen atmosphere to facilitate breakdown of the mold.

33. The method of claim 23, wherein stimulating the casting with a high energy pulsation includes directing a pressurized fluid at exterior walls of the mold with a force sufficient to cause the mold to fracture.

34. The method of claim 33, wherein the pressurized fluid comprises heated air, thermal oils or water.

* * * * *